US009233544B2

(12) United States Patent
Akahane et al.

(10) Patent No.: US 9,233,544 B2
(45) Date of Patent: Jan. 12, 2016

(54) HEAD UNIT AND LIQUID EJECTING APPARATUS

(71) Applicant: SEIKO EPSON CORPORATION, Tokyo (JP)

(72) Inventors: Fujio Akahane, Azumino (JP); Hiroaki Okui, Azumino (JP); Keiji Hara, Yokohama (JP); Yasuyuki Kudo, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 126 days.

(21) Appl. No.: 14/211,258

(22) Filed: Mar. 14, 2014

(65) Prior Publication Data

US 2014/0285574 A1 Sep. 25, 2014

(30) Foreign Application Priority Data

Mar. 25, 2013 (JP) ..... 2013-061426

(51) Int. Cl.

| | |
|---|---|
| ***B41J 2/15*** | (2006.01) |
| ***B41J 2/175*** | (2006.01) |
| ***B41J 2/145*** | (2006.01) |
| ***B41J 2/14*** | (2006.01) |
| ***B41J 2/155*** | (2006.01) |

(52) U.S. Cl.

CPC *B41J 2/175* (2013.01); *B41J 2/145* (2013.01); *B41J 2/14233* (2013.01); *B41J 2/155* (2013.01); *B41J 2002/14491* (2013.01); *B41J 2202/19* (2013.01); *B41J 2202/20* (2013.01)

(58) Field of Classification Search

None

See application file for complete search history.

(56) References Cited

U.S. PATENT DOCUMENTS

| | | | | |
|---|---|---|---|---|
| 2006/0044355 | A1* | 3/2006 | Ito | B41J 2/14209 347/59 |
| 2007/0070103 | A1 | 3/2007 | Akune et al. | |
| 2009/0295867 | A1 | 12/2009 | Oguchi | |
| 2010/0110136 | A1 | 5/2010 | Drury et al. | |

FOREIGN PATENT DOCUMENTS

| | | |
|---|---|---|
| EP | 1705018 | 9/2006 |
| JP | 2012-183758 | 9/2012 |

OTHER PUBLICATIONS

European Search Report for Application No. 14160685.5 dated Jul. 3, 2014.

* cited by examiner

*Primary Examiner* — Stephen Meier
*Assistant Examiner* — Bradley Thies
(74) *Attorney, Agent, or Firm* — Workman Nydegger

(57) ABSTRACT

A head unit, in which unit head rows are formed by respectively arraying unit heads in parallel on both sides of a transmission substrate. The head unit includes a first liquid fluid channel that is disposed on a first side of the transmission substrate and a second liquid fluid channel that is disposed on a second side of the transmission substrate. The unit heads are provided with a flexible cable. A first head fluid channel sandwiches the flexible cable and is provided on a side that is opposite a transmission substrate side. A second head fluid channel is provided on the transmission substrate side. The first head fluid channel is in communication with a first liquid fluid channel on a surface side on which the unit heads are disposed. The second head fluid channel straddles the transmission substrate and is in communication with a second liquid fluid channel on a surface side that is opposite the unit heads.

12 Claims, 6 Drawing Sheets

HEAD UNIT AND LIQUID EJECTING APPARATUS

BACKGROUND

1. Technical Field

The present invention relates to a head unit that is provided with a plurality of unit heads that eject a liquid from a nozzle, and a liquid ejecting apparatus.

2. Related Art

A liquid ejecting apparatus is an apparatus that is provided with a liquid ejecting head that is capable of ejecting a liquid as liquid droplets from a nozzle, and that ejects various liquids from the liquid ejecting head. As a representative example of this kind of liquid ejecting apparatus, it is possible to include an image recording apparatus such as an ink jet type recording apparatus (printer) that is provided with an ink jet type recording head (hereinafter, referred to as a recording head) and performs recording by ejecting a liquid ink (in the form of ink droplets) from a nozzle of the recording head. Further, in addition to the above, liquid ejecting apparatuses are used in the ejecting of various types of liquid such as coloring materials that are used in color filters for liquid crystal displays and the like, organic materials that are used in organic EL (Electro Luminescence) displays, and electrode materials that are used in electrode formation. Further, liquid ink is ejected in recording heads for image recording apparatuses, and solutions of the respective color materials of R (Red), G (Green) and B (Blue) are ejected from color material ejecting heads for display manufacturing apparatuses. In addition, liquid electrode material is ejected from electrode material ejecting heads for electrode formation apparatuses, and solutions of living organic matter are ejected from living organic matter ejecting heads for chip production apparatuses.

In a printer such as that mentioned above, a single recording head that ejects ink is configured as a unit head, and there are printers in which a single head unit is configured by arraying a plurality of such unit heads (for example, refer to JP-A-2012-183758). Each unit head introduces ink from an ink supply source (such as an ink cartridge) into a pressure chamber (pressure generation chamber), generates a pressure variation in the ink inside the pressure chamber by operating pressure generation units such as a piezoelectric element or a heater element. Further, each unit head is configured to eject the ink inside the pressure chamber (in the form of ink droplets) from a nozzle (formed as an opening in a nozzle surface) using the pressure variation. In addition, a head unit such as that described above is provided with a transmission substrate that sends a drive signal to each of the pressure generation units.

In recent years, the miniaturization of head units has been progressing. For example, head units are being developed in which a plurality of unit heads (in which two nozzle rows are provided) are arrayed on both surface sides of a transmission substrate that forms a base of a wiring substrate. Each head unit is provided with a flexible cable, one end of which is connected to the transmission substrate. Further, a fluid channel that is in communication with each nozzle row is provided on both sides of the flexible cable with the flexible cable interposed therebetween. That is, a fluid channel that is on the transmission substrate side and a fluid channel that is on a side that is opposite thereto are provided in each unit head with the flexible cable interposed therebetween. If such a configuration is adopted, since the fluid channel that is on the transmission substrate side is disposed between the transmission substrate and the flexible cable, a contact portion of the transmission substrate and the flexible cable becomes an obstruction in cases in which the fluid channel on the transmission substrate side comes into contact with the fluid channel on the upstream side. In particular, since the width of the flexible cable with respect to the unit head becomes relatively larger if unit heads are miniaturized, the arrangement of a fluid channel that comes into contact between the fluid channel on the upstream side and the fluid channel of the unit head becomes complicated, and the connection of fluid channels is more difficult.

SUMMARY

An advantage of some aspects of the invention is that it provides a head unit in which a unit head has a plurality of nozzle rows. The nozzle rows are arrayed on both surface sides of a transmission substrate without forming a complicated liquid fluid channel. Also described herein is a liquid ejecting apparatus that is provided with the head unit.

According to an aspect of the present invention, there is provided a head unit, in which unit head rows are formed by arraying a plurality of unit heads. The unit head rows are respectively arranged in parallel on both surface sides of a thickness direction of a transmission substrate. The head until includes unit heads that have a nozzle surface, in which nozzle rows including a plurality of nozzles are formed, and pressure generation units that generate a pressure variation in pressure chambers that are in communication with the nozzles, and that eject a liquid from the nozzles by generating a pressure variation in the pressure chambers by operating the pressure generation units, a transmission substrate that is vertically arranged along a direction which intersects the nozzle surface, and that transmits a drive signal to the pressure generation units, and a liquid fluid channel member that has a liquid fluid channel that supplies a liquid to the unit heads. The liquid fluid channel has a first liquid fluid channel that is disposed on a first side of the thickness direction of the transmission substrate and a second liquid fluid channel that is disposed a second side of the thickness direction of the transmission substrate. The unit heads are provided with a flexible cable that is electrically connected to the pressure generation units and the transmission substrate, a first head fluid channel that sandwiches the flexible cable and is provided on a side that is opposite a transmission substrate side, and a second head fluid channel that, with respect to the first head fluid channel, sandwiches the flexible cable and is provided on the transmission substrate side. Among the first liquid fluid channel and the second liquid fluid channel, the first head fluid channel is in communication with a first liquid fluid channel on a surface side on which the unit heads are disposed, and among the first liquid fluid channel and the second liquid fluid channel, the second head fluid channel straddles the transmission substrate and is in communication with a second liquid fluid channel on a surface side that is positioned on a side that is opposite the unit heads.

According to this configuration, since there is no longer interference between the flexible cable and the communication fluid channels that connect the head fluid channels and the liquid fluid channels, it becomes possible to array unit heads that have a plurality of nozzle rows on both surface sides of a transmission substrate without forming a complicated liquid fluid channel.

In the abovementioned configuration, it is desirable that the head unit be further provided with a fixing member that is fixed to the liquid fluid channel member on one side, and fixed to the unit heads on the other side, the fixing member have a first communication fluid channel that is in communication with the first head fluid channel and the first liquid fluid channel and a second communication fluid channel that is in communication with the second head fluid channel and the second liquid fluid channel for each unit head, and the second communication fluid channel straddle the transmission substrate and extend toward the second liquid fluid channel from the second head fluid channel.

In addition, in the abovementioned configuration, it is desirable that the liquid fluid channel member have a valve that controls the influx of the liquid from the liquid fluid channel to a head fluid channel side.

Furthermore, in the abovementioned configuration, it is desirable that the transmission substrate be configured by a single substrate.

In addition, it is desirable that, among the two surfaces of the transmission substrate, the flexible cable that the unit heads are provided with be connected to a surface on a side on which the unit heads are disposed.

According to this configuration, the connection of the flexible cable is made easy. In addition, since it becomes possible to superimpose a flexible cable that is connected to a first surface side of the transmission substrate and a flexible cable that is connected to a second surface side of the transmission substrate in a plate thickness direction of the transmission substrate, miniaturization of the head unit becomes possible.

Furthermore, in the abovementioned configuration, it is desirable that the head unit be further provided with a metal plate that extends along a surface direction of the transmission substrate on at least one of the surface sides of the transmission substrate, and the metal plate be provided with a hole section that faces a connection portion of the transmission substrate and the flexible cable, and into which it is possible to insert the flexible cable.

According to this configuration, it is possible to make the head unit rigid. For example, it is possible to prevent a circumstance in which the head unit itself becomes deformed due to heat when the flexible cable is attached to the transmission substrate using thermocompression bonding. In addition, it is possible to block the noise of electromagnetic waves that move toward the transmission substrate from outside the head unit.

Further, according to another aspect of the present invention, there is provided a liquid ejecting apparatus that includes the head unit of the abovementioned configurations.

BRIEF DESCRIPTION OF THE DRAWINGS

The invention will be described with reference to the accompanying drawings, wherein like numbers reference like elements.

FIGS. 1A and 1B are schematic views that describe the configuration of a printer, in which FIG. 1A is a plan view and FIG. 1B is a side view.

FIG. 7A is a cross-sectional view VIIA-VIIA in FIG. 3 and FIG. 7B is a cross-sectional view VIIB-VIIB in FIG. 3.

DESCRIPTION OF EXEMPLARY EMBODIMENTS

Hereinafter, forms for implementing the present invention will be described with reference to the accompanying drawings. Additionally, in the embodiments that are described below, various limitations are given as preferred specific examples of the present invention. However, the scope of the present invention is not limited to these aspects unless a feature that limits the present invention is specifically stated in the following description. In addition, in the following description, an ink jet type printer (hereinafter, referred to as a printer 1) is used as an example of a liquid ejecting apparatus of the present invention. In printer 1, there are mounted a plurality of ink jet recording heads (hereinafter, referred to as unit heads), which are a type of liquid ejecting head.

Figure 1A:
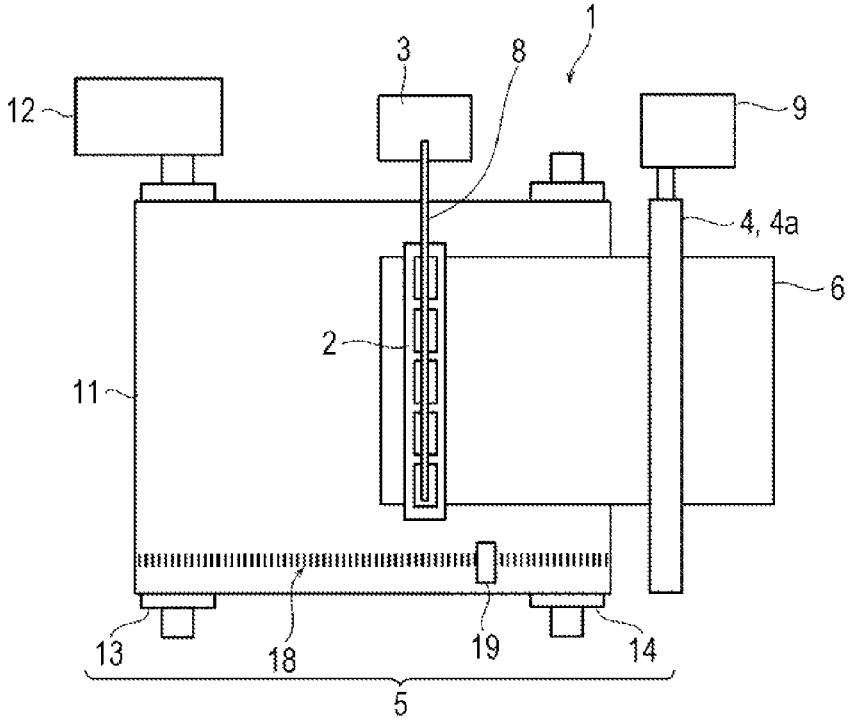
Figure 1B:
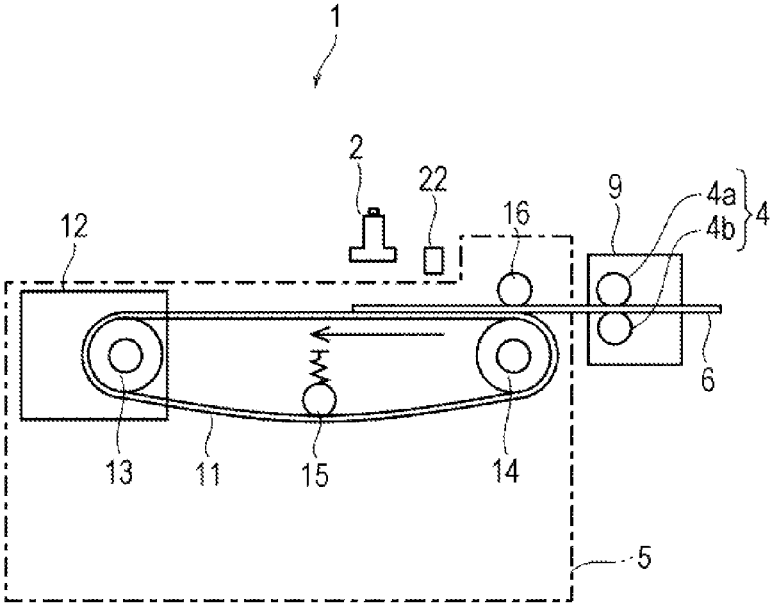

FIG. 1A is a plan view schematically illustrating a configuration of the printer 1. FIG. 1B is a lateral view in which the configuration of the printer 1 is schematically displayed. The printer 1 is provided with a head unit 2, an ink tank 3, a paper supply roller 4 and a transport mechanism 5. The head unit 2 is a device in which a plurality of unit heads 7 are arrayed, which unit heads 7 perform recording of images or the like by ejecting a liquid ink. The head unit 2 extends in an oblong manner along a paper width direction (a direction that is perpendicular to a transport direction of recording paper 6) of recording paper 6 (a type of recording medium or landing object). The ink tank 3 is a type of storage member (a liquid supply source) in which ink is stored for supply to the head unit 2. The ink that is inside the ink tank 3 is supplied to the head unit 2 through an ink supply tube 8. Additionally, it is possible to employ a configuration in which the liquid supply source is mounted above the head unit 2. In addition, a detailed configuration of the head unit 2 will be described later.

The paper supply roller 4 is arranged upstream of the transport mechanism 5, and is configured by an upper and lower pair of rollers 4*a*, 4*b* that are capable of synchronous rotation in mutually opposing directions so as to sandwich and grasp recording paper 6 that is supplied from a paper supply section (not shown in the drawings). The paper supply roller 4 is driven by power from a paper supply motor 9, and supplies the recording paper 6 to a transport mechanism 5 side after correcting a tilt of the recording paper with respect to the transport direction and after shifting of the direction that is orthogonal to the transport direction of the recording paper 6 by causing collaborative interaction of skew correction rollers (not shown in the drawings).

The transport mechanism 5 is provided with a transport belt 11, a transport motor 12, a drive roller 13, a driven roller 14, a tension roller 15 and a pressure contact roller 16. The transport motor 12 is a drive source of the transport mechanism 5, and conveys power to the drive roller 13. The transport belt 11 is an endless belt, and is stretched tightly between the drive roller 13 and the driven roller 14. The tension roller 15 is in contact with an inner peripheral surface of the transport belt 11 between the drive roller 13 and the driven roller 14, and applies a tensile force to the transport belt 11 using a biasing force of a biasing member such as a spring. The pressure contact roller 16 is arranged directly above the driven roller 14 with the transport belt 11 interposed therebetween, and presses the recording paper 6 on the transport belt 11.

A linear scale 18 is arranged over the entire circumference of the belt on an outer peripheral surface of the transport belt 11. The linear scale 18 is configured by arraying a plurality of slit-shaped patterns for detection at regular intervals (for example, 360 per linear inch) in a transport direction of the transport belt 11. The patterns for detection of the linear scale 18 are detected optically by a detection head 19, and detected signals are output as encoder signals to a control unit (not shown in the drawings) of the printer 1. Therefore, based on the encoder signal, the control unit can ascertain the amount that the recording paper 6 has been transported using the transport mechanism 5 (the transport belt 11). In addition, the encoder signal defines a generation timing of the drive signal for driving a piezoelectric element 65 (to be described later) of the unit heads 7.

Figure 2:
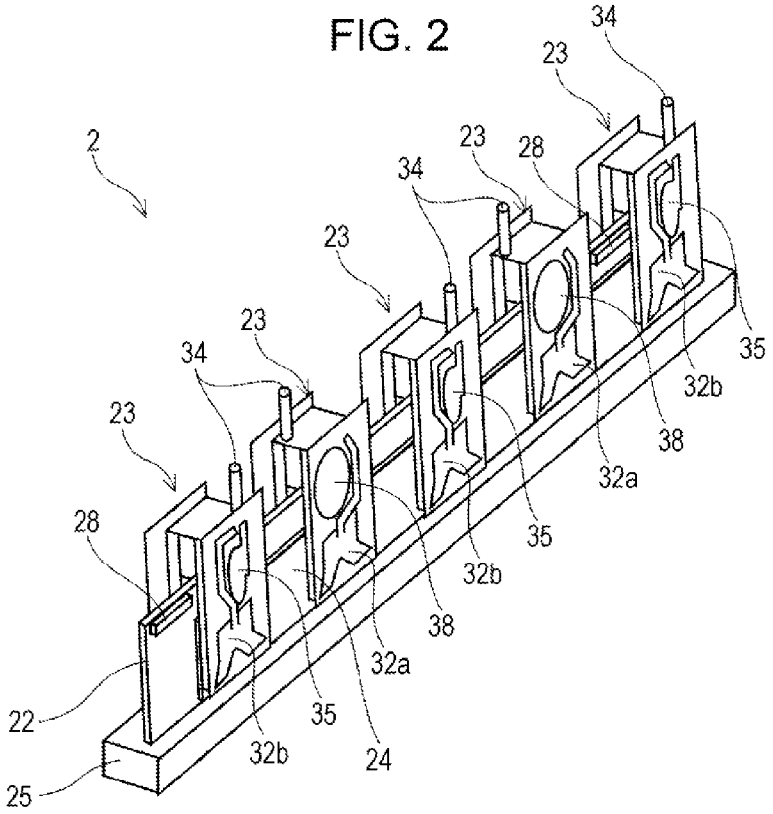
FIG. 2 is a perspective view of a head unit.
Figure 3:
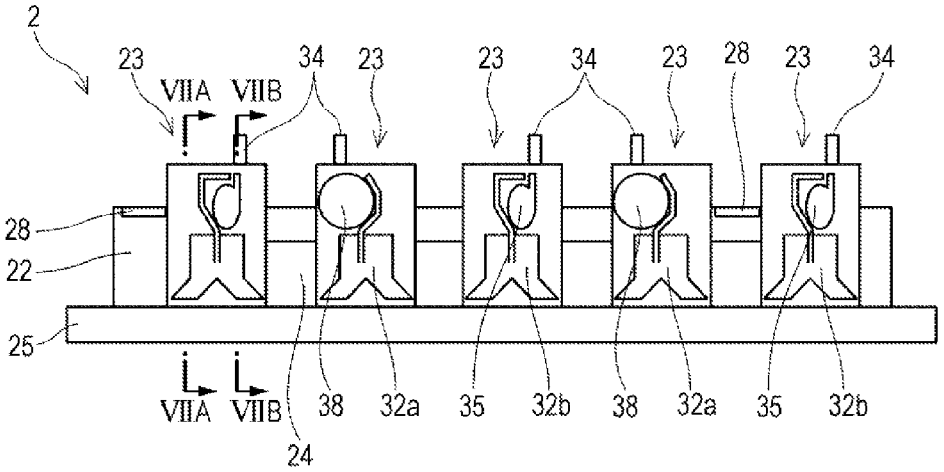
FIG. 3 is a front view of a head unit.
Figure 4:
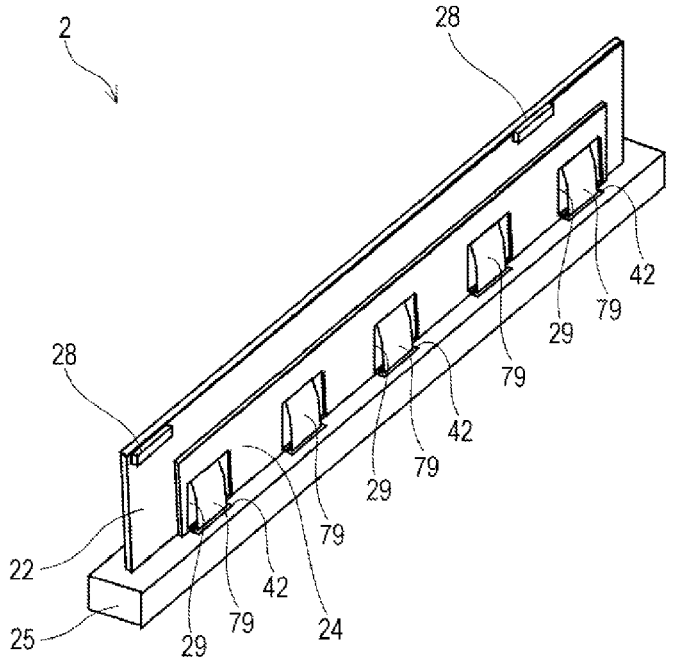
FIG. 4 is a perspective view of a head unit in a state in which a valve unit is detached.
Figure 5:
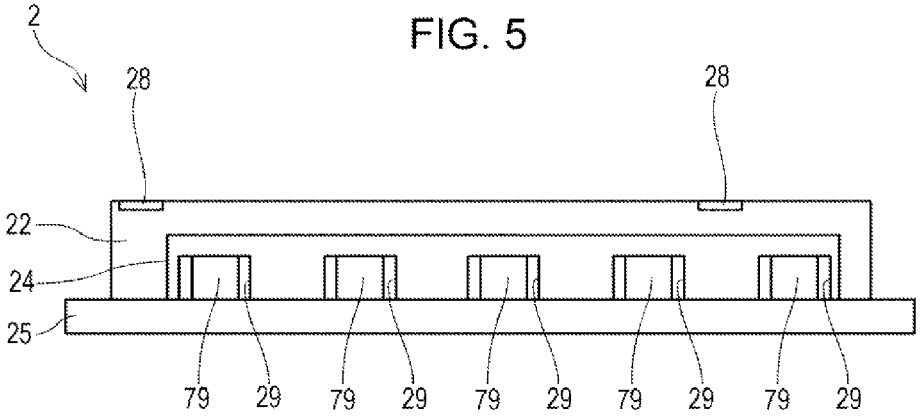
FIG. 5 is a front view of a head unit in a state in which a valve unit is detached.
Figure 6:
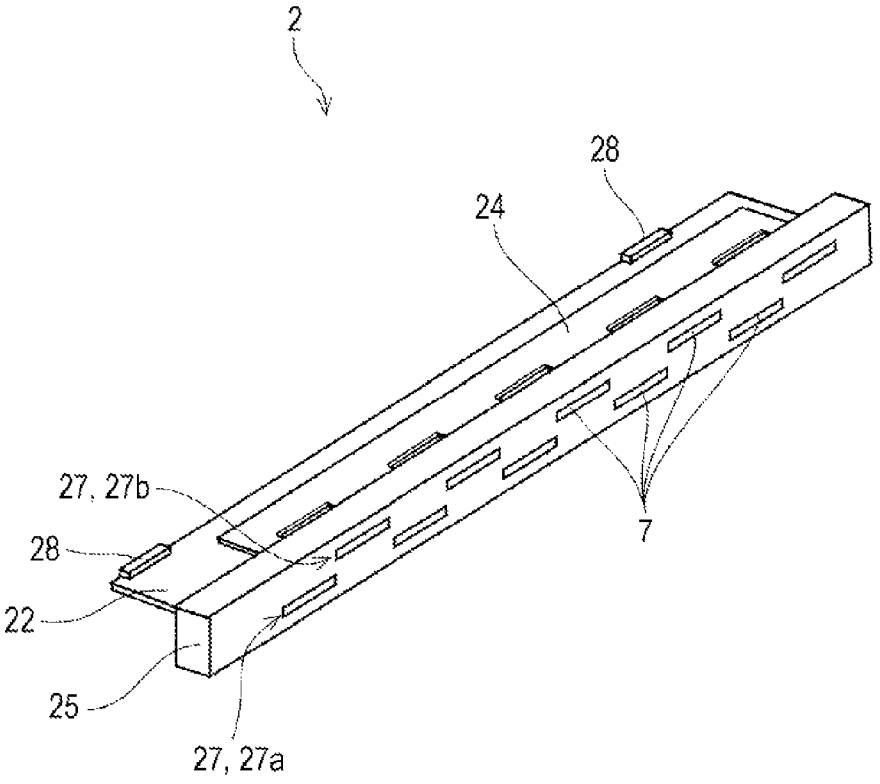
FIG. 6 is a perspective view of a head unit in a state in which a valve unit is detached viewed from a nozzle surface side.
Figure 7A:
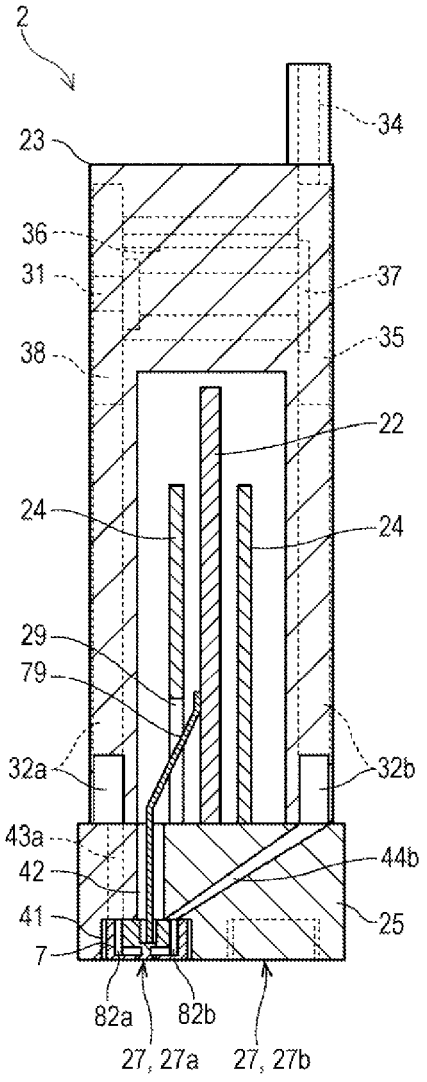
FIGS. 7A and 7B are schematic views that describe the configuration of a printer.
Figure 7B:
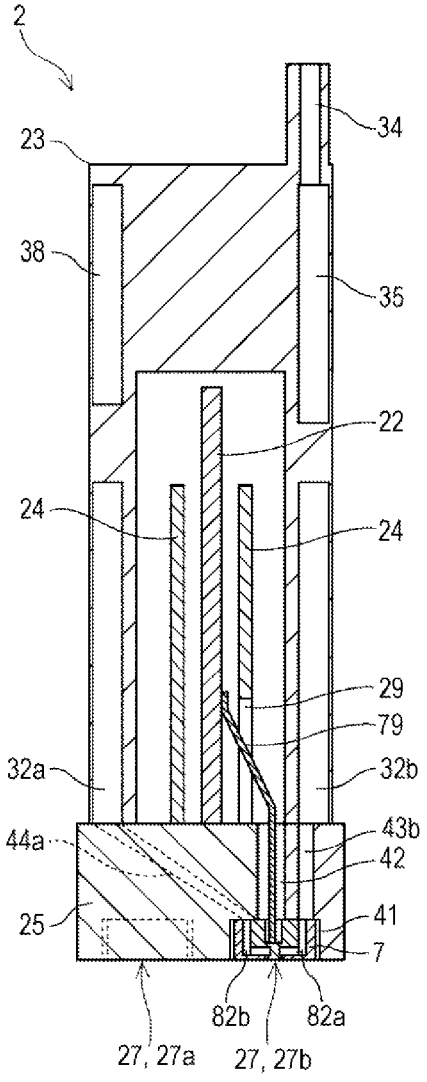

Next, the head unit 2 will be described using the drawings. FIGS. 2 and 4 are perspective views of the head unit 2, and FIGS. 3 and 5 are front views of the head unit 2. In addition, FIG. 6 is a perspective view of the head unit 2 viewed from a nozzle surface 58 side. Furthermore, FIG. 7A is a cross-sectional view VIIA-VIIA in FIG. 3 and FIG. 7B is a cross-sectional view VIIB-VIIB in FIG. 3. Additionally, in FIGS. 4 to 6, valve units 23 have been omitted for the convenience of description. In addition, in the head unit 2 of the present embodiment, valve units 23 are alternately arrayed with the front and back thereof being reversed from one another and with a transmission substrate 22 interposed therebetween. However, since the configuration of each valve unit 23 is the same, the following description is made focusing on one valve unit 23 (the left-end valve unit in FIG. 2 or FIG. 3).

The head unit 2 in the present embodiment is provided with a plurality of unit heads 7 (refer to FIG. 6). In addition, the head unit 2 includes a plate-form transmission substrate 22 that extends upwards (vertically arranged) along a direction (a direction perpendicular to the nozzle surface 58 in the present embodiment) that intersects the nozzle surface 58 (refer to a nozzle plate 52 and FIG. 9) of the unit heads 7. The head unit 2 further includes a valve unit 23 (which corresponds to a liquid fluid channel member in the present invention) that extends over both surface sides of the transmission substrate 22 with the transmission substrate interposed therebetween. Also, the head unit 2 includes a metal plate 24 that is raised up in parallel with the transmission substrate 22. Finally, the head unit 2 includes a case 25 (which corresponds to a fixing member in the present invention) to which the unit heads 7, the transmission substrate 22, the valve unit 23 and the metal plate 24 are fixed. In addition, in the present embodiment, as shown in FIG. 6, two unit head rows 27 are aligned along a longitudinal direction of the head unit 2 and are each formed by arraying 5 unit heads 7 at regular intervals along the longitudinal direction. A line head is configured by lining up a first unit head row 27*a* and a second unit head row 27*b* to be shifted by the pitch of the unit heads 7.

The transmission substrate 22 is a single substrate that transmits a drive signal that is sent from the control unit to the piezoelectric element 65 of each unit head 7. As shown in FIG. 4 and the like, the transmission substrate 22 is fixed to an upper surface (which is the side opposite side to the unit heads 7) of the case 25 in an upwardly extending state. As shown in FIGS. 7A and 7B, the transmission substrate 22 is substantially the center of a width direction of the case 25, and is disposed in a position that corresponds to a position that is between two unit head rows 27. In other words, the unit head rows 27 are respectively arranged in parallel on both of the surface sides (both surface sides) of a thickness direction of the transmission substrate 22. In addition, electronic components such as capacitors and transistors (not shown in the drawings) are mounted on both surfaces of the transmission substrate 22. Furthermore, in the lower portion of the transmission substrate 22, a flexible cable 79 (to be described later) of the unit heads 7 is respectively electrically connected to a position that corresponds to each unit head 7. In the present embodiment, among the two surfaces of the transmission substrate 22, the flexible cable 79 of the unit heads 7 (that are arranged in parallel on both side surfaces of the transmission substrate 22) is connected to a surface on a side on which the unit heads 7 are disposed. That is, the flexible cable 79 is respectively connected to both surfaces of the transmission substrate 22. Additionally, a connector 28 is disposed in an upper end section of the upwardly extending transmission substrate 22. An end side of a cable (the other end side which is electrically connected to the control unit) is electrically connected to the connector 28. As a result of this configuration, signals and the like from the control unit are processed by being delivered to the electronic components through the connector 28, and are subsequently supplied to each unit head 7 through the flexible cable 79. The connector 28 of the present embodiment is respectively provided at both longitudinal end sections of the transmission substrate 22.

As shown in FIG. 4 and the like, the metal plate 24 is a pectinate plate material that extends along a surface direction of the transmission substrate 22. Two metal plates 24 are fixed to the upper surface of the case 25 with the transmission substrate 22 interposed therebetween. The metal plate 24 of the present embodiment is formed slightly smaller than the transmission substrate 22, and is disposed on both surface sides of the transmission substrate 22 with the transmission substrate 22 positioned therebetween. In addition, the metal plate 24 is provided with a hole section 29 so as to face a connection portion of the transmission substrate 22 and the flexible cable 79, and into which it is possible to insert the flexible cable 79. The hole section 29 is formed by notching in a concave manner from the lower end of the metal plate 24 to partway into the upper end of the metal plate 24. In addition, in the present embodiment, since five unit heads 7 are arrayed on one surface side of the transmission substrate 22, five hole sections 29 are provided to correspond thereto. Further, with respect to the transmission substrate 22, the flexible cable 79 is connected to the transmission substrate 22 by being inserted into the corresponding hole section 29 of the metal plate 24 from the side that is opposite the side on which the metal plate 24 is interposed.

The valve unit 23 stably supplies ink that is introduced from the ink tank 3 to the unit heads 7, and an on-off valve 31 (also referred to as a self-sealing valve, and which corresponds to a valve in the present invention) is provided partway through an internal fluid channel thereof. As shown in FIGS. 7A and 7B, the valve units 23 of the present embodiment are disposed straddling the transmission substrate 22 throughout both surface sides of the thickness direction of the transmission substrate 22. The internal sections of the valve units 23 are provided with a first liquid fluid channel 32*a* that is disposed on a first surface side (the left-hand side in FIGS. 7A and 7B (the unit head row 27*a* side)) of the thickness direction of the transmission substrate 22 and a second liquid fluid channel 32*b* that is disposed on a second surface side (the right-hand side in FIGS. 7A and 7B (the unit head row 27*b* side)) of the thickness direction of the transmission substrate 22. In addition, an introduction channel 34 (that is liquid-tightly connected with the ink supply tube 8) protrudes upward at the upper portion of the second liquid fluid channel 32*b* of the valve unit 23. Therefore, ink inside the ink tank 3 is introduced into the inside of the introduction channel 34 through the ink supply tube 8. In addition, as shown in FIG. 3, a lower end of the introduction channel 34 is in communication with an elliptical filter chamber 35 in a front view that is formed on the second surface side (the second liquid fluid channel 32*b* side). As shown in FIG. 7A, an end of an internal fluid channel 36 (the other end of which is in communication with a pressure adjustment chamber 38 that is formed on the first surface side (the first liquid fluid channel 32*a* side)), is in communication with a downstream side of the filter chamber 35. Further, a filter 37 that removes waste and the like is provided at a communication location of the internal fluid channel 36 of the filter chamber 35. The pressure adjustment chamber 38 is formed in a circular shape in a front view and is sealed by a thin film. The on-off valve 31 is provided at a location that faces the film which is a communication location of the pressure adjustment chamber 38 of the internal fluid channel 36. Therefore, as the pressure of the internal section of the pressure adjustment chamber 38 becomes negative, the film bends in a direction that opens the on-off valve 31 by applying a pressing force thereto. As a result of this, the on-off valve 31 is opened and ink from the introduction channel 34 is supplied to the pressure adjustment chamber 38 side through the filter 37.

In addition, an end of a first connection fluid channel (not shown in the drawings) (the other end of which is in communication with the second liquid fluid channel 32*b* of the second surface side (the filter chamber 35 side)) is open at a position that is different from that of the internal fluid channel 36. Ink that has passed through the on-off valve 31 flows into the second liquid fluid channel 32*b* through the first connection fluid channel. The second liquid fluid channel 32*b* extends downward along the surface direction of the transmission substrate 22, and is open at the bottom end section of the valve unit 23. The second liquid fluid channel 32*b* of the present embodiment branches into two forks partway therealong and among the two unit head rows 27*a*, 27*b*, ink is supplied to unit heads 7 that are disposed in the first unit head row 27*a* and unit heads 7 that are disposed in the second unit head row 27*b* through communication fluid channels 44 of the case 25 that will be described later. More specifically, as shown in FIG. 7A, a first branch of the second liquid fluid channel 32*b* is connected to the a second communication fluid channel 44*b*, and as shown in FIG. 7B, a second branch of the second liquid fluid channel 32*b* is connected to the a first communication fluid channel 43*b* that will be described later. In addition, a second connection fluid channel (not shown in the drawings) that is in communication with the first liquid fluid channel 32*a* and the second liquid fluid channel 32*b* is provided partway along the second liquid fluid channel 32*b* in a position that is further on the upstream side of the branching. By the second connection fluid channel, ink that has flowed into the second liquid fluid channel 32*b* from the pressure adjustment chamber 38 is supplied to the first liquid fluid channel 32*a* side.

The first liquid fluid channel 32*a* extends downward along the surface direction of the transmission substrate 22 in the same manner as the second liquid fluid channel 32*b*, and is open at the bottom end section of the valve unit 23. The first liquid fluid channel 32*a* of the present embodiment branches into two forks partway therealong and among the two unit head rows 27*a*, 27*b*, ink is supplied to unit heads 7 that are disposed in the first unit head row 27*a* and unit heads 7 that are disposed in the second unit head row 27*b*. More specifically, as shown in FIG. 7A, a first branch of the first liquid fluid channel 32*a* is connected to a first communication fluid channel 43*a* that is different from the first communication fluid channel 43*b* that the second liquid fluid channel 32*b* is in communication with, and as shown in FIG. 7B, a second branch of the first liquid fluid channel 32*a* is connected to the a second communication fluid channel 44*a* that is different from the second communication fluid channel 44*b* that the second liquid fluid channel 32*b* is in communication with. That is, the fluid channels that are provided in the valve unit 23 of the present embodiment branch into four after passing the on-off valve 31, and are respectively in communication with the four communication fluid channels 43*a*, 43*b*, 44*a*, 44*b* of the case 25. As a result of this configuration, ink from the valve unit 23 is supplied to the two corresponding unit heads 7 (four head fluid channels 82 that will be described later) through the communication fluid channels 43*a*, 43*b*, 44*a*, 44*b*. Additionally, the internal fluid channel 36, the first connection fluid channel and the second connection fluid channel that have been described above are provided in a portion that is above (a side that is opposite the case 25) the transmission substrate 22 in valve unit 23.

The case 25 is a member that is formed from a resin or the like. The upper surface (a surface that is on a side that is opposite the unit head 7 side) of the case 25 is fixed to the transmission substrate 22, the metal plate 24 and the valve unit 23. The case 25 of the present embodiment is formed so as to be longer than the transmission substrate 22 in the longitudinal direction of the head unit 2. Head fixing hollow sections 41 (that are concave from the lower surface thereof to partway into the upper portion thereof) are provided on a lower surface side of the case 25 at positions that correspond to the unit heads 7, and the unit heads 7 are fixed into the inside of the head fixing hollow sections 41. That is, five head fixing hollow sections 41 are lined up to correspond to the unit head row 27*a* that is arrayed on a first side of the transmission substrate 22, and five head fixing hollow sections 41 are lined up to correspond to the unit head row 27*b* that is arrayed on a second side of the transmission substrate 22 shifted by a distance of the lining-up pitch of the unit heads 7. In other words, the head fixing hollow sections 41 are alternately arrayed along a longitudinal direction of the case 25 on the first side and the second side of the transmission substrate 22 with the transmission substrate 22 interposed therebetween. In addition, cable insertion hollow sections 42 (into which the flexible cable 79 of the unit heads 7 are inserted) are provided in the upper portion of the head fixing hollow sections 41 by penetrating in a plate thickness direction (a vertical direction in FIGS. 7A and 7B) of the case 25. Each cable insertion hollow section 42 open at the substantial central portion of the head fixing hollow sections 41 in a width direction of the case 25 to correspond to the flexible cable 79 of the unit heads 7.

As shown in FIGS. 7A and 7B, a first communication fluid channel 43 that sandwiches the cable insertion hollow section 42 extends in a vertical direction (a direction that is perpendicular to the nozzle surface 58) at the outer side of the cable insertion hollow section 42 (a side that is opposite the transmission substrate 22). The lower end of the first communication fluid channel 43 opens into the head fixing hollow section 41, and is in liquid-tight communication with the upper end of a first head fluid channel 82*a* (an ink introduction path 75) that will be described later. More specifically, a first communication fluid channel 43*a* of the first surface side (the unit head row 27*a* side) among the two surface sides of the transmission substrate 22, is in communication with a first head fluid channel 82*a* of the unit heads 7 that are disposed in the unit head row 27*a*. Likewise, a first communication fluid channel 43*b* of the second surface side (the unit head row 27*b* side) among the two surface sides of the transmission substrate 22, is in communication with a first head fluid channel 82*a* of the unit heads 7 that are disposed in the unit head row 27*b*. In addition, the upper ends of the first communication fluid channels 43*a*, 43*b* are in liquid-tight communication with either the first liquid fluid channel 32*a* or the second liquid fluid channel 32*b*. That is, as shown in FIG. 7A, the upper end of the first communication fluid channel 43*a* that is provided on the first surface side (the unit head row 27*a* side) among the two surface sides of the transmission substrate 22, is in liquid-tight communication with the first liquid fluid channel 32*a*. Meanwhile, as shown in FIG. 7B, the upper end of the first communication fluid channel 43*b* that is provided on the second surface side (the unit head row 27*b* side) among the two surface sides of the transmission substrate 22, is in liquid-tight communication with the second liquid fluid channel 32*b*.

In addition, a second communication fluid channel 44 that sandwiches the cable insertion hollow section 42 straddles the lower portion of the transmission substrate 22 and extends diagonally at the inner side (a transmission substrate 22 side) of the cable insertion hollow section 42. On a side that is opposite the first communication fluid channel along the width of the case 25, the lower end of the second communication fluid channel 44 is open to the cable insertion hollow section 42 inside the head fixing hollow section 41. Furthermore, the lower end of the second communication fluid channel 44 is in liquid-tight communication with the upper end of a second head fluid channel 82*b* (an ink introduction path 75) that will be described later. More specifically, the lower end of a second communication fluid channel 44*b* (the upper end of which is open on the second surface side (the unit head row 27*b* side) among the two surface sides of the transmission substrate 22) is in communication with a second head fluid channel 82*b* of the unit heads 7 that are disposed in the unit head row 27*a*. Likewise, the lower end of a second communication fluid channel 44*a* (the upper end of which is open on the first surface side (the unit head row 27*a* side) among the two surface sides of the transmission substrate 22) is in communication with a second head fluid channel 82*b* of the unit heads 7 that are disposed in the unit head row 27*b*. Further, in the same manner as the first communication fluid channel 43, the upper ends of the second communication fluid channels 44*a*, 44*b* are in liquid-tight communication with either the first liquid fluid channel 32*a* or the second liquid fluid channel 32*b*, respectively. That is, as shown in FIG. 7A, the upper end of the first communication fluid channel 44*b* (that is open on the second surface side (the unit head row 27*b* side) among the two surface sides of the transmission substrate 22) straddles the transmission substrate 22 and is in liquid-tight communication with the second liquid fluid channel 32*b*. Meanwhile, as shown in FIG. 7B, the upper end of the second communication fluid channel 44*a* (that is open on the first surface side (the unit head row 27*a* side) among the two surface sides of the transmission substrate 22) straddles the transmission substrate 22 and is in liquid-tight communication with the first liquid fluid channel 32*a*.

In summary, the lower end of the first communication fluid channel 43 (a communication fluid channel 43 that is perpendicular with the outer side) and the lower end of the second communication fluid channel 44 (a communication fluid channel 44 that is inclined downward from the outer side toward the inner side) respectively sandwich the cable insertion hollow sections 42 and are open at the head fixing hollow section 41. Further, since the first liquid fluid channel 32*a* or the second liquid fluid channel 32*b* is positioned directly above the first communication fluid channel 43, the first communication fluid channel 43 extends in the vertical direction and is in communication with the liquid fluid channel 32. Meanwhile, if an attempt is made to extend the second communication fluid channel 44 in the vertical direction and connect the second communication fluid channel 44 to the upper liquid fluid channel 32 in the same manner as the first communication fluid channel 43, the cable insertion hollow sections 42 or the flexible cable 79 become obstacles, and it becomes difficult to communicate with the liquid fluid channel 32. However, since the two unit head rows 27*a*, 27*b* are disposed shifted by a distance of the lining-up pitch thereof in the head unit 2, the flexible cable 79 (cable insertion hollow sections 42) of unit heads 7 that belong to other unit head rows 27 are not disposed on an opposite side (other unit head row 27 sides that are different from the unit head row 27 that belongs to the unit heads 7 with which the second communication fluid channel 44 is in communication) that sandwiches the transmission substrate 22. Therefore, it is possible for the second communication fluid channel 44 to straddle the lower portion of the transmission substrate 22 and be in communication with the first liquid fluid channel 32*a* or the second liquid fluid channel 32*b* that are positioned on an opposite side (a side that is opposite the unit head row 27 that belongs to the unit heads 7 with which the second communication fluid channel 44 is in communication) that sandwiches the transmission substrate 22.

Figure 8:
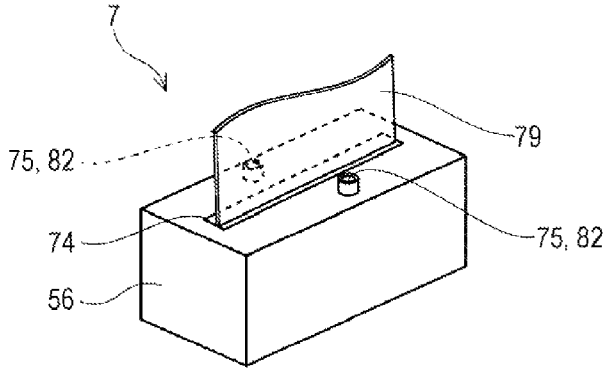
FIG. 8 is a perspective view of a unit head.
Figure 9:
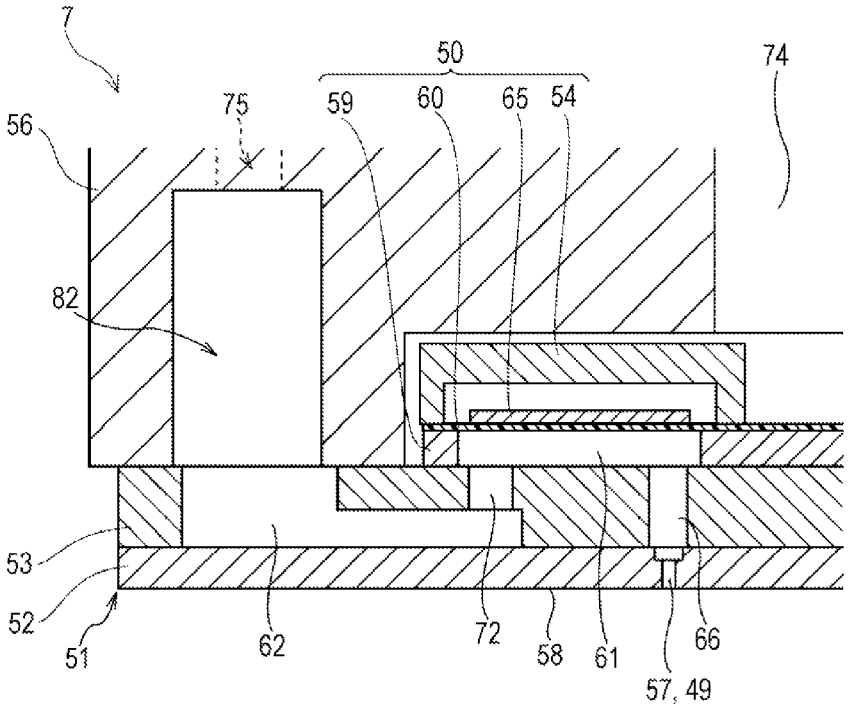
FIG. 9 is a cross-sectional view of the main parts of a unit head.

Next, the unit heads 7 will be described. FIG. 8 is a perspective view of a unit head 7. FIG. 9 is a cross-sectional view of the main parts of the unit head 7. Additionally, the unit heads 7 in the present embodiment are provided with two nozzle rows 49 that are formed by lining up a plurality of nozzles. However, in FIG. 9, a configuration that corresponds to a second nozzle row 49 is omitted since the above configuration is horizontally symmetrical to a configuration that corresponds to a first nozzle row 49 that is shown in the drawing. In addition, for the convenience of description, the lamination layer direction of each member is described as the vertical direction.

As shown in FIG. 9, the unit heads 7 in the present embodiment are provided with a pressure generation unit 50 and a fluid channel unit 51, and are configured by these members being attached to a head case 56 in a laminated state. The head case 56 is a synthetic resin box-shaped member that comprises a large portion of the upper surface and the lateral surfaces of the unit heads 7. The upper portion of the head case 56 is fixed to the head fixing hollow section 41 of the case 25. In addition, as shown in FIG. 8, a penetrating hollow section 74 that has an elongated rectangular hole is formed in a central portion in a plan view of the head case 56 along a nozzle row direction. The penetrating hollow section 74 penetrates the head case 56 in a height direction. An end of the flexible cable 79 is stored in the penetrating hollow section 74.

Furthermore, an ink introduction path 75 is formed in the head case 56. The ink introduction path 75 is a fluid channel that configures the upstream side of the head fluid channels 82. Furthermore, as shown in FIG. 8, an upper end of the ink introduction path 75 protrudes from the upper surface of the head case 56. In the present embodiment, two ink introduction paths 75 sandwich the flexible cable 79 and protrude from the upper surface of both sides to correspond to the two nozzle rows 49, and are respectively connected to the lower end of either the first communication fluid channel 43 or the second communication fluid channel 44 of the case 25. That is, as shown in FIG. 7A which shows the unit heads 7 being fixed to the case 25, the ink introduction path 75 (that is disposed on the outer side (a side that is opposite the transmission substrate 22 with respect to the flexible cable 79)) defines the first head fluid channel 82*a*. Further, as shown in FIG. 7B, which also shows the unit heads 7 being fixed to the case 25, the ink introduction path 75 (that is disposed on the inner side (a transmission substrate 22 side with respect to the flexible cable 79)) defines the second head fluid channel 82*b*. Additionally, the two ink introduction paths 75 that protrude from the upper surface of the head case 56 are disposed in the same direction in the central portion of the longitudinal direction (the nozzle row direction) of the head case 56 slightly shifted in from one another. In addition, the lower end of the ink introduction path 75 is in communication with a common liquid fluid channel 62 of a communication substrate 53.

The fluid channel unit 51 has a nozzle plate 52 and a communication substrate 53. The communication substrate 53 is a plate material in which the common liquid fluid channel 62, an individual communication opening 72 and the like are formed. The common liquid fluid channel 62 is a fluid channel that is common to each pressure chamber 61, the upstream side of which is connected to the ink introduction path 75, and is formed in two rows to correspond to the pressure chambers 61 (or the nozzles 57) that are formed in two rows. The common liquid fluid channel 62 is in communication with each pressure chamber 61 through the individual communication opening 72. The nozzle plate 52 is a plate material (that is made from a silicon substrate or the like) in which a plurality of nozzles 57 are provided in an open manner in row form at a pitch that corresponds to a dot formation density. This plurality of lined-up nozzles 57 configure a nozzle row 49 (a type of nozzles group) by providing from one end side of nozzles 57 to another end side of nozzles 57 at regular intervals. In the present embodiment, two nozzle rows 49 are formed in the nozzle plate 52. Additionally, the lower surface of the nozzle plate 52 corresponds to the nozzle surface 58.

The pressure generation unit 50 is positioned in the lower section of the of the head case 56 in a state in which a pressure chamber formation substrate 59 (a type of pressure chamber formation member) in which the pressure chamber 61 is formed, an elastic film 60, a so-called deflection vibration type piezoelectric element 65 (corresponds to a pressure generation units in the present invention) and a protecting substrate 54 are laminated and unitized. Electrode wiring sections (not shown in the drawings) respectively extend to the penetrating hollow section 74 side from each piezoelectric element 65, and a terminal of one end side of the flexible cable 79 is connected to the electrode wiring sections. In addition, each pressure chamber 61 is respectively in communication with the nozzles 57 on a side that is opposite the individual communication opening 72 through the nozzle communication paths 66 that are formed in the communication substrate 53.

Further, the head fluid channels 82 are configured by a series of fluid channels that is formed from the ink introduction path 75, the common liquid fluid channel 62, the individual communication opening 72, the pressure chamber 61, the nozzle communication paths 66 and the nozzles 57. In the present embodiment, two head fluid channels 82 are provided with the flexible cable 79 interposed therebetween, and respectively correspond to the first head fluid channel 82*a* and the second head fluid channel 82*b*. More specifically, in a state in which the unit heads 7 are fixed to the case 25, a head fluid channel (that is disposed on the outer side (a side that is opposite the transmission substrate 22 with respect to the flexible cable 79)) corresponds to the first head fluid channel 82*a*. Further, in the state in which the unit heads 7 are fixed to the case 25, an ink introduction path 75 (that is disposed on the inner side (a transmission substrate 22 side with respect to the flexible cable 79)) corresponds to the second head fluid channel 82*b*.

In a head unit 2 with such a configuration, ink from the ink tank 3 is supplied to each valve unit 23 through the ink supply tube 8. The ink that is supplied to the valve unit 23 branches into the first liquid fluid channel 32*a* and the second liquid fluid channel 32*b* after passing through the on-off valve 31, further branches downstream of the liquid fluid channels 32*a*, 32*b*, and is introduced into four head fluid channels 82 through the communication fluid channels 43*a*, 43*b*, 44*a*, 44*b*. That is, ink is supplied to two unit heads 7 that are on both sides of the transmission substrate 22 in the thickness direction thereof from a single valve unit 23. If described in more detail, as shown in FIG. 7A, ink from the first liquid fluid channel 32*a* is supplied to the first head fluid channel 82*a* (a head fluid channel 82 on the outer side) of the unit heads 7 that are disposed on the first liquid fluid channel 32*a* side of the transmission substrate 22 through the first communication fluid channel 43*a*. In addition, ink from the second liquid fluid channel 32*b* is supplied to the second head fluid channel 82*b* (a head fluid channel 82 on the inner side) of the corresponding unit heads 7 through the second communication fluid channel 44*b*. Meanwhile, as shown in FIG. 7B, ink from the second liquid fluid channel 32*b* is supplied to the first head fluid channel 82*a* (a head fluid channel 82 on the outer side) of the unit heads 7 that are disposed on the second liquid fluid channel 32*b* side of the transmission substrate 22 through the first communication fluid channel 43*b*. In addition, ink from the first liquid fluid channel 32*a* is supplied to the second head fluid channel 82*b* (a head fluid channel 82 on the inner side) of the corresponding unit heads 7 through the second communication fluid channel 44*a*. Additionally, in the valve units that are disposed with the front and back thereof being reversed from one another and the transmission substrate interposed therebetween, the opposite communication fluid channels to those described above are connected to the first liquid fluid channel and the second liquid fluid channel.

Further, in a state in which each head fluid channels 82 is filled with ink, the piezoelectric element 65 is bent by supplying a drive signal from the control unit to the piezoelectric element 65 through the transmission substrate 22 and the flexible cable 79. As a result of this configuration, a pressure variation is generated inside the pressure chamber 61, and ink droplets are ejected from the nozzles 57 by using the pressure variation.

In this manner, since, among the first liquid fluid channel 32*a* and the second liquid fluid channel 32*b*, the first head fluid channel 82*a* is in communication with a first liquid fluid channel 32 of the surface side on which the unit heads 7 are disposed, and among the first liquid fluid channel 32*a* and the second liquid fluid channel 32*b*, the second head fluid channel 82*b* straddles the transmission substrate 22 and is in communication with a second liquid fluid channel 32 of the surface side (an opposite surface side) that is positioned opposite the unit heads 7, it becomes possible to array the unit heads 7 that have a plurality of nozzle rows 49 on both surface sides of the transmission substrate 22 without forming a complicated liquid fluid channel. In addition, since it is not necessary to from a complicated liquid fluid channel, the piping arrangement workability of the liquid fluid channel is improved. Furthermore, since, among the two surfaces of the transmission substrate 22 that is configured by one plate, the flexible cable 79 that the unit heads 7 are provided with is connected to a surface of a side on which the unit heads 7 are disposed, connection of the flexible cable 79 is more easily made. In addition, since it becomes possible to superimpose the flexible cable 79 that is connected to a first surface side of the transmission substrate 22 and a flexible cable 79 that is connected to a second surface side thereof in a plate thickness direction of the transmission substrate 22, it is possible to reduce the lining-up pitch of the unit head rows 27 and miniaturization of the head unit becomes possible. Furthermore, since the head unit is provided with a metal plate 24 that extends along a surface direction of the transmission substrate 22 on at least one of the surface sides of the transmission substrate 22, and the metal plate 24 is provided with a hole section 29 so as to face a connection portion of the transmission substrate 22 and the flexible cable 79, and into which it is possible to insert the flexible cable 79, it is possible to make the head unit 2 rigid. For example, it is possible to prevent a circumstance in which the case 25 (or the head unit 2 itself) becomes deformed due to heat when the flexible cable 79 is attached to the transmission substrate 22 using thermocompression bonding. In addition, it is possible to block the noise of electromagnetic waves that move toward the transmission substrate 22 from outside the head unit 2.

Incidentally, in the abovementioned embodiment, a single unit head row 27 is configured by five unit heads 7, but it is possible to configure a single unit head row 27 using a plurality of unit heads without being limited to this configuration. In addition, two nozzle rows 49 are provided in the nozzle surface 58 of the unit heads 7, but it is possible to provide a plurality of nozzle rows without being limited to this configuration. In addition, the nozzle rows are not limited to nozzle rows in which the nozzles are lined up in a straight line. For example, nozzle rows are possible in which are arrayed diagonally with respect to a lining-up direction (a paper width direction of the recording paper) of the unit heads, or so-called two-dimensional arrangement type nozzle rows (nozzles groups) which are arrayed along the paper width direction of the recording paper, and in which adjacent nozzles are alternately shifted with respect to the transport direction of the recording paper (a direction that is orthogonal to the paper width direction of the recording paper). In brief, provided nozzle rows (nozzle groups) are respectively disposed on both sides of a flexible cable of the unit heads with the flexible cable interposed therebetween, and fluid channels that supply ink to the nozzle rows (nozzle groups) are respectively formed on both sides of a flexible cable with the flexible cable interposed therebetween, the configuration is included in the technical scope of the present invention. Furthermore, in the abovementioned embodiment, two plates of the metal plate 24 are provided to sandwich the transmission substrate 22, but the metal plate may be provided on at least one surface side of the transmission substrate without being limited to this configuration. In addition, in the abovementioned embodiment, a so-called deflection vibration type piezoelectric element 65 was exemplified as the pressure generation units, but for example, it is possible to adopt a so-called longitudinal vibration type piezoelectric element or heater element without being limited to this configuration.

Furthermore, in the abovementioned embodiment, ink was supplied to four head fluid channels 82 (two unit heads 7) through the communication fluid channels 43*a*, 43*b*, 44*a*, 44*b* from a single valve unit 23, but the present invention is not limited to this configuration. For example, a valve unit that has an on-off valve and a first liquid fluid channel may be disposed on one side of the thickness direction of the transmission substrate, and a valve unit that has an on-off valve and a second liquid fluid channel may be disposed on the other side thereof. That is, it is possible to configure such that ink is supplied to two head fluid channels from a single valve unit through the communication fluid channels. In a case in which ink is supplied to two head fluid channels from a single valve unit, since an ink flow amount inside the valve unit decreases relatively in comparison with a case in which ink is supplied to four head fluid channels from a single valve unit, pressure loss inside the fluid channels decreases, and it is easier to supply ink to the inside of head fluid channels. However, in a case in which ink is supplied to four head fluid channels from a single valve unit in the manner of the abovementioned embodiment, since one on-off valve is used for four head fluid channels, miniaturization is possible. Additionally, in a case in which valve units are respectively disposed on both sides of the thickness direction of the transmission substrate, two valve units sandwich the transmission substrate and form a pair correspond to the liquid fluid channel member in the present invention.

Further, in the abovementioned embodiment, ink jet recording heads that are mounted in an ink jet type printer are exemplified, but it is possible to apply the invention to apparatuses that eject liquids other than ink. For example, it is also possible to apply the present invention to a color material ejecting head that is used in the production of color filters such as liquid crystal displays, electrode material ejecting heads that are used in the electrode formation such as organic EL (Electro Luminescence) displays, and FED (field emission displays), and living organic matter ejecting heads that are used in the production of biochips.

The entire disclosure of Japanese Patent Application No: 2013-061426, filed Mar. 25, 2013 is expressly incorporated by reference herein in its entirety.

What is claimed is:

1. A head unit, in which unit head rows that are formed by arraying a plurality of unit heads, are respectively arranged in parallel on both surface sides of a thickness direction of a transmission substrate, the head unit comprising:

unit heads that have a nozzle surface, in which nozzle rows including a plurality of nozzles are formed, and pressure generation units that generate a pressure variation in pressure chambers that are in communication with the nozzles, and that eject a liquid from the nozzles by generating a pressure variation in the pressure chambers by operating the pressure generation units;

a transmission substrate that is vertically arranged along a direction which intersects the nozzle surface, and that transmits a drive signal to the pressure generation units; and a liquid fluid channel member that has a liquid fluid channel that supplies a liquid to the unit heads, wherein the liquid fluid channel has a first liquid fluid channel that is disposed on a first side of the thickness direction of the transmission substrate and a second liquid fluid channel that is disposed a second side of the thickness direction of the transmission substrate, wherein the unit heads are provided with a flexible cable that is electrically connected to the pressure generation units and the transmission substrate, a first head fluid channel that sandwiches the flexible cable and is provided on a side that is opposite a transmission substrate side, and a second head fluid channel that, with respect to the first head fluid channel, sandwiches the flexible cable and is provided on the transmission substrate side, and wherein, among the first liquid fluid channel and the second liquid fluid channel, the first head fluid channel is in communication with a first liquid fluid channel on a surface side on which the unit heads are disposed, and wherein among the first liquid fluid channel and the second liquid fluid channel, the second head fluid channel straddles the transmission substrate and is in communication with a second liquid fluid channel on a surface side that is positioned on a side that is opposite the unit heads.

2. The head unit according to claim 1, further comprising:

a fixing member that is fixed to the liquid fluid channel member on one side, and fixed to the unit heads on the other side, wherein the fixing member has a first communication fluid channel that is in communication with the first head fluid channel and the first liquid fluid channel and a second communication fluid channel that is in communication with the second head fluid channel and the second liquid fluid channel for each unit head, and wherein the second communication fluid channel straddles the transmission substrate and extends toward the second liquid fluid channel from the second head fluid channel.

3. The head unit according to claim 1, wherein the liquid fluid channel member has a valve that controls the influx of the liquid from the liquid fluid channel to a head fluid channel side.

4. The head unit according to claim 1, wherein the transmission substrate is configured by a single substrate.

5. The head unit according to claim 4, wherein, among the two surfaces of the transmission substrate, the flexible cable that the unit heads are provided with is connected to a surface on a side on which the unit heads are disposed.

6. The head unit according to claim 1, further comprising:

a metal plate that extends along a surface direction of the transmission substrate on at least one of the surface sides of the transmission substrate, wherein the metal plate is provided with a hole section that faces a connection portion of the transmission substrate and the flexible cable, and into which it is possible to insert the flexible cable.

7. A liquid ejecting apparatus comprising a head unit, the head unit including head rows that are formed by arraying a plurality of unit heads, which are respectively arranged in parallel on both surface sides of a thickness direction of a transmission substrate, the head unit comprising:

unit heads that have a nozzle surface, in which nozzle rows including a plurality of nozzles are formed, and pressure generation units that generate a pressure variation in pressure chambers that are in communication with the nozzles, and that eject a liquid from the nozzles by generating a pressure variation in the pressure chambers by operating the pressure generation units;

a transmission substrate that is vertically arranged along a direction which intersects the nozzle surface, and that transmits a drive signal to the pressure generation units; and a liquid fluid channel member that has a liquid fluid channel that supplies a liquid to the unit heads, wherein the liquid fluid channel has a first liquid fluid channel that is disposed on a first side of the thickness direction of the transmission substrate and a second liquid fluid channel that is disposed a second side of the thickness direction of the transmission substrate, wherein the unit heads are provided with a flexible cable that is electrically connected to the pressure generation units and the transmission substrate, a first head fluid channel that sandwiches the flexible cable and is provided on a side that is opposite a transmission substrate side, and a second head fluid channel that, with respect to the first head fluid channel, sandwiches the flexible cable and is provided on the transmission substrate side, and wherein, among the first liquid fluid channel and the second liquid fluid channel, the first head fluid channel is in communication with a first liquid fluid channel on a surface side on which the unit heads are disposed, and wherein among the first liquid fluid channel and the second liquid fluid channel, the second head fluid channel straddles the transmission substrate and is in communication with a second liquid fluid channel on a surface side that is positioned on a side that is opposite the unit heads.

8. A liquid ejecting apparatus according to claim 7, the head unit further comprising:

a fixing member that is fixed to the liquid fluid channel member on one side, and fixed to the unit heads on the other side, wherein the fixing member has a first communication fluid channel that is in communication with the first head fluid channel and the first liquid fluid channel and a second communication fluid channel that is in communication with the second head fluid channel and the second liquid fluid channel for each unit head, and wherein the second communication fluid channel straddles the transmission substrate and extends toward the second liquid fluid channel from the second head fluid channel.

9. A liquid ejecting apparatus according to claim 7, wherein the liquid fluid channel member has a valve that controls the influx of the liquid from the liquid fluid channel to a head fluid channel side.

10. A liquid ejecting apparatus in accordance with claim 7, wherein the transmission substrate is configured by a single substrate.

11. A liquid ejecting apparatus in accordance with claim 10, wherein, among the two surfaces of the transmission substrate, the flexible cable that the unit heads are provided with is connected to a surface on a side on which the unit heads are disposed.

12. A liquid ejecting apparatus in accordance with claim 7, the head unit further comprising a metal plate that extends along a surface direction of the transmission substrate on at least one of the surface sides of the transmission substrate, wherein the metal plate is provided with a hole section that faces a connection portion of the transmission substrate and the flexible cable, and into which it is possible to insert the flexible cable.

* * * * *